US005706963A

United States Patent [19]

Gargione

[11] Patent Number: 5,706,963

[45] Date of Patent: Jan. 13, 1998

[54] CHILD RESISTANT CLOSURE

[76] Inventor: Frank V. Gargione, 106 S. Genoa Ave., Egg Harbor, N.J. 08215

[21] Appl. No.: 689,675

[22] Filed: Aug. 13, 1996

[51] Int. Cl.[6] ..... B65D 50/08

[52] U.S. Cl. ..... 215/219; 215/217

[58] Field of Search ..... 215/216, 217, 215/218, 219, 221, 223, 329, 330, 331

[56] References Cited

U.S. PATENT DOCUMENTS

| | | | |
|---|---|---|---|
| 3,770,153 | 11/1973 | Gach et al. | 215/216 |
| 3,989,152 | 11/1976 | Julian . | |
| 4,149,646 | 4/1979 | Julian | 215/216 |
| 4,213,534 | 7/1980 | Montgomery | 215/216 |
| 4,464,316 | 8/1984 | Michaels | 215/216 X |
| 4,540,098 | 9/1985 | Luker | 215/216 |
| 4,567,991 | 2/1986 | Anderson | 215/216 |
| 4,752,014 | 6/1988 | House et al. | 215/216 |
| 4,948,002 | 8/1990 | Thornock et al. . | |
| 5,383,564 | 1/1995 | Hamilton et al. | 215/216 X |
| 5,460,281 | 10/1995 | Rapchak et al. . | |
| 5,586,671 | 12/1996 | Thomas et al. | 215/216 X |
| 5,603,421 | 2/1997 | Opresco | 215/217 |

FOREIGN PATENT DOCUMENTS

| | | | |
|---|---|---|---|
| 2001079 | 4/1990 | Canada | 215/217 |
| 1524395 | 9/1978 | United Kingdom | 215/216 |
| 90/02692 | 3/1990 | WIPO | 215/217 |

*Primary Examiner*—Allan N. Shoap
*Assistant Examiner*—Nathan Newhouse
*Attorney, Agent, or Firm*—Brady, O'Boyle & Gates

[57] ABSTRACT

The child resistant closure of the present invention comprises a cap having a first skirt portion adapted to be threaded on the neck of a container, and a second skirt portion having a pair diametrically disposed tabs provided with depending lugs adapted to engage a pair of diametrically disposed upwardly extending lugs integral with a ring molded integral with the neck of the container below the thread portion thereon. The lugs on the ring are positioned in proximity to the outer peripheral edge of the ring and are configured so that when screwing the cap onto the container the tab lugs will deflect radially outwardly when ratcheting over the ring lugs. When turning the cap in the opposite direction, the tab lugs engage the ring lugs to prevent removal of the cap. To remove the cap, the tabs are manually pressed radially inwardly away from the ring lugs while the cap is being turned in a direction to unscrew it from the container.

2 Claims, 1 Drawing Sheet

CHILD RESISTANT CLOSURE

BACKGROUND OF THE INVENTION

Various child resistant closures have been proposed wherein the closures are provided with tabs engageable with lugs on the container to prevent removal of the closure without first deflecting the tabs away from the lugs.

The child resistant closure of the present invention is an improvement over the above-noted tab-lug type child resistant closures in that the child resistant closure of the present invention has fewer parts, and because of its construction and arrangement it can be readily fabricated by molding.

SUMMARY OF THE INVENTION

The child resistant closure of the present invention comprises a cap having a first skirt portion adapted to be threaded on the neck of a container, and a second skirt portion having a pair of diametrically disposed tabs provided with depending lugs adapted to engage a pair of diametrically disposed upwardly extending lugs integral with a ring molded integral with the neck of the container below the thread portion thereon. The lugs on the ring are positioned in proximity to the outer peripheral edge of the ring and are configured so that when screwing the cap onto the container the tab lugs will deflect radially outwardly when ratcheting over the ring lugs. When turning the cap in the opposite direction, the tab lugs engage the ring lugs to prevent removal of the cap. To remove the cap, the tabs are manually pressed radially inwardly away from the ring lugs while the cap is being turned in a direction to unscrew it from the container.

DESCRIPTION OF THE PREFERRED EMBODIMENTS

Figure 1:
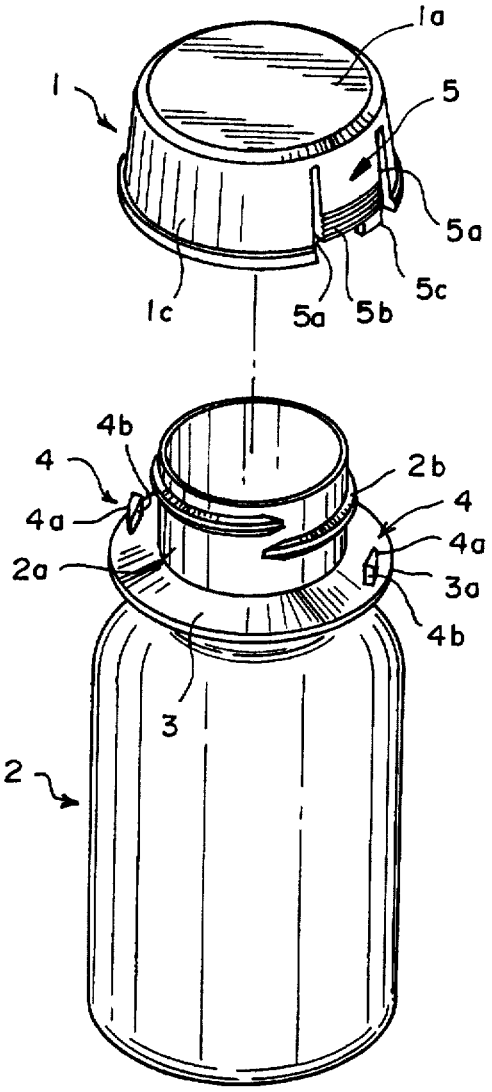
FIG. 1 is an exploded perspective view of the container and closure of the present invention.
Figure 2:
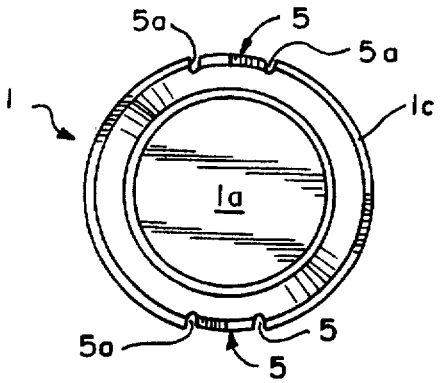
FIG. 2 is a top plan view of the closure.
Figure 3:
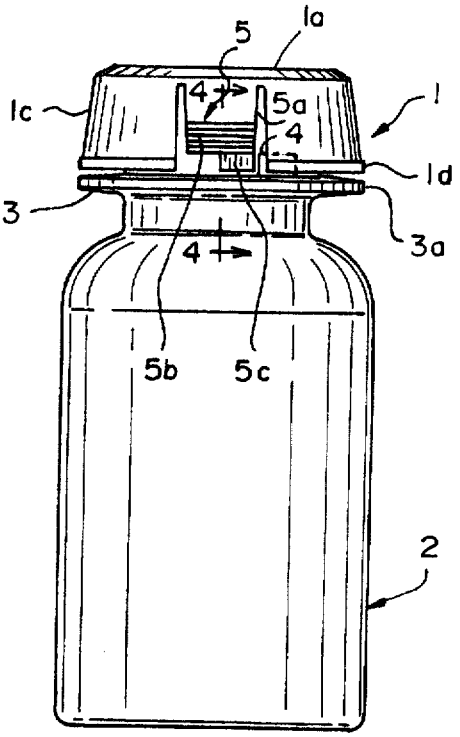
FIG. 3 is a side elevational view of the closure threaded on the container.
Figure 4:
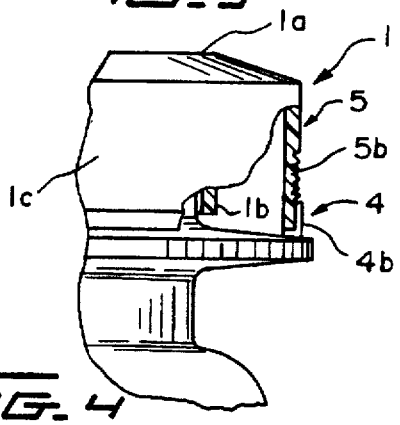
FIG. 4 is a view taken along line 4—4 of FIG. 3.

Referring to the drawings and, more particularly to FIGS. 1 to 4, the closure of the present invention comprises a cap 1 having a top wall 1*a* and a first skirt 1*b* depending therefrom and a second depending skirt 1*c* spaced radially outwardly from the first skirt 1*b*.

The container 2 is provided with a neck portion 2*a* having a threaded portion 2*b* on which the first skirt 1*b* of the cap 1 is adapted to be threadably mounted.

A ring member 3 is integrally molded onto the neck portion 2*a* of the container below the threaded portion 2*b*. The outer peripheral edge 3*a* of the ring member 3 is in close proximity to and substantially coextensive with the lower peripheral edge 1*d* of the second skirt 1*c*. A pair of diametrically disposed upwardly extending lugs 4 are integral with the ring 3. Each lug 4 includes an outwardly tapered side wall 4*a* and a vertical end wall 4*b*.

A pair of depending, diametrically disposed, resilient tabs 5 are provided in the second skirt 1*c*. Each tab 5 is defined by a pair of slots 5*a* provided in the skirt 1*c*, and the lower end portion of the tab is provided with a serrated thumb and finger engaging portion 5*b* and a depending lug 5*c*.

When applying the cap 1 to the container 2, the first skirt 1*b* is threaded onto the container neck 2*a* while the tab lugs 5*c* will slide over the tapered side wall 4*a* of the ring lug 4, whereby the tabs 5 are spread radially outwardly during the ratcheting of the tab lugs 5*c* over the ring lugs 4. Any attempt to remove the cap 1 from the container 2 by turning the cap 1 in the opposite or counterclockwise direction will be prevented by the tab lugs 5*c* engaging the end walls 4*b* of the ring tabs 4.

Figure 5:
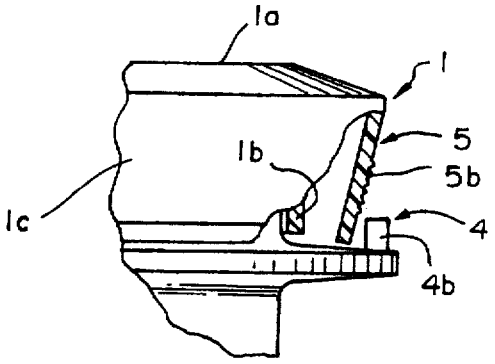
FIG. 5 is a fragmentary side elevational view, partly in section of the closure shown in FIG. 4, showing one of the tabs moved radially inwardly for removal of the closure from the container.

To remove the cap 1, the thumb and forefinger of the user engage the serrated portion 5*b* of respective tabs 5 which are then squeezed radially inwardly, as shown in FIG. 5, to thereby remove the tab lug 5*c* from abutting relationship with the ring lug 4. While in this position, the cap 1 can be simultaneously turned in a counterclockwise direction to remove the cap 1 from the container 2.

From the above description, it will be readily appreciated by those skilled in the art that the child resistant closure of the present invention is simple in construction having few parts and which is readily fabricated by molding processes. By positioning the outer peripheral edge 3*a* of the ring member 3 in close proximity to and substantially coextensive with the lower peripheral edge 1*d* of the second skirt 1*c*, the lug 4 is hidden from the view of a child, and by having the tabs 5 integral with and coextensive with the second skirt 1*c* there are no radially outwardly extending components to attract the curiosity of the child.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A child resistant package comprising a cap to be threaded on a neck of a container, said cap having a top wall, a first skirt integral with and depending downwardly from said top wall, said first skirt secured to the threaded neck portion of the container, a second skirt portion integral with and depending downwardly from said top wall, said second skirt being positioned radially outwardly from said first skirt, a pair of diametrically disposed resilient, depending tabs integral and coextensive with the second skirt, each tab being defined by a pair of slots in said second skirt, the uppermost portion of each of said slots being spaced below said top wall, a depending lug integral with the lower end of each depending tab, a ring member integral with the neck of said container and positioned below the threaded portion thereon, a pair of diametrically disposed upwardly extending lugs integral with the ring member and positioned in proximity to the outer peripheral edge of the ring member, the lower peripheral edge of the second skirt being in close proximity to and coextensive with the outer peripheral edge of the ring member, whereby the upwardly extending lugs are hidden from a child's view, said depending tab lugs being engagable with said upwardly extending lugs on said ring member to prevent removal of said cap from said container, said tabs being manually squeezable radially inwardly, whereby the depending tab lugs are removed from the path of the upwardly extending lugs to thereby allow the cap to be unthreaded from the container.

2. The child resistant closure according to claim 1, wherein each upwardly extending lug has an outwardly tapered side wall and a vertical end wall, whereby when the cap is threaded onto the container the depending tab lugs deflect radially outwardly allowing the depending tab lugs to ratchet over the upwardly extending lugs, the depending tab lugs engaging the vertical end walls on the upwardly extending lugs when the cap is turned in a direction to remove the cap from the container.

* * * * *